United States Patent [19]

Bischoff et al.

[11] Patent Number: 4,461,794

[45] Date of Patent: Jul. 24, 1984

[54] FLOOR COVERING AND METHOD FOR INSTALLING A FLOOR COVERING

[75] Inventors: Dieter Bischoff; Armando Favorite, both of Fürth, Fed. Rep. of Germany

[73] Assignee: Firma Carl Freudenberg, Weinheim, Fed. Rep. of Germany

[21] Appl. No.: 464,887

[22] Filed: Feb. 8, 1983

[30] Foreign Application Priority Data

Mar. 31, 1982 [DE] Fed. Rep. of Germany ..... 3211855

[51] Int. Cl.[3] ..... B32B 25/14; B32B 25/16; C09J 5/00; C09J 5/02

[52] U.S. Cl. ..... 428/57; 156/305; 156/307.1; 156/307.3; 156/308.2; 156/308.6; 156/309.3; 428/251; 428/285; 428/286; 428/441; 428/515; 428/517; 428/519; 428/913

[58] Field of Search ..... 156/305, 307.1, 307.3, 156/308.2, 308.6, 309.3; 428/57, 251, 285, 286, 441, 515, 517, 519, 913

[56] References Cited

U.S. PATENT DOCUMENTS 4,153,748 5/1979 Bischoff ..... 428/517

*Primary Examiner*—James C. Cannon

*Attorney, Agent, or Firm*—Kenyon & Kenyon

[57] ABSTRACT

This application discloses a sealing floor covering useful in moist rooms and outdoor areas, comprising an undercoat and an outermost surface covering bonded to the undercoat. The undercoat is comprised of at least three bonded-together layers of a vulcanizable elastomeric material and at least one intermediate layer of the undercoat contains a vulcanization accelerator.

9 Claims, No Drawings

FLOOR COVERING AND METHOD FOR INSTALLING A FLOOR COVERING

BACKGROUND OF THE INVENTION

This invention relates to a floor covering particularly well suited for use in moist rooms and on outside surfaces. The floor covering reliably seals the covered sub-flooring against external influences and the use of additional insulation is unnecessary.

When laying conventional floors on patios, balconies, in moist rooms, etc., it is commonly necessary to first apply an undercoating which blocks moisture. Next, an outermost surface covering which is suitable to be walked upon is applied to the undercoating. The installation requires several steps. In spite of the usual precautionary measures taken, the undercoating is often not watertight, and water damage often occurs particularly under high stress.

As undercoating, bitumen layers of varying thicknesses are used, upon which thick foam material sheets, for instance, of polystyrene, are placed for distributing the pressure. This, however, results in a thick structure which is not suitable for use in old buildings and, for space reasons, not always suitable for use in new buildings.

Wear-resistant, thin floor coverings, for instance, those comprised of rubber often cannot be laid without difficulty on conventional undercoatings. While rubber is water and weather resistant, it is known that in conjunction with these desirable properties, rubber floor coverings tend to repel adhesive, so that rubber sheets exhibit little adhesion to conventional undercoatings. The adhesion obtained is, as a rule, not sufficient to securely bond the wear-resistant layer. In addition, installation often must take place in wet and outside areas, where the choice of adhesives is very limited because of the danger of hydrolysis of the adhesive. Therefore, the installation process becomes very elaborate and expensive.

It is an object of this invention to develop a combined sealing cover and an outermost surface floor covering suitable to be walked upon which is absolutely reliable with respect to moisture blockage, has minimal thickness, and is mechanically resistant (i.e. wear resistant). The outermost surface covering of this invention is comprised of synthetic rubber.

It is also an object of this invention to provide a method for installing a floor covering which satisfies the objectives outlined above. It is also an object of this invention to provide an economical method for installing such a covering.

BRIEF DESCRIPTION OF THE INVENTION

In accordance with the foregoing objectives, the present invention provides a sealing floor covering suitable for use in moist rooms and outdoor areas comprising an undercoat and an outermost surface covering bonded to the undercoat, wherein the undercoat comprises at least three bonded-together layers of a vulcanizable elastomeric material, wherein at least one intermediate layer of said undercoat contains vulcanization accelerator, and the outermost surface covering is comprised of at least two bonded-together layers of a synthetic rubber in web or sheet form, wherein at least one layer of the surface covering includes vulcanization accelerator, but the layer of the surface covering which contacts the undercoat does not contain vulcanization accelerator.

This invention also provides a method for installing a floor covering comprising:

(a) arranging a plurality of undercoat sheets in a side-by-side fashion, with the edges of said sheets overlapping to completely cover the sub-flooring, wherein the undercoat sheets are comprised of at least three bonded-together layers of a vulcanizable elastomeric material, wherein at least one intermediate layer of said undercoat sheet includes a vulcanization accelerator, and (b) bonding said undercoat sheets together in the area of overlap, and (c) solvent or thermally bonding an outermost surface covering comprised of at least two layers of a synthetic rubber to the undercoat, wherein at least one layer of the surface covering contains a vulcanization accelerator, but the layer of the surface covering contacting the undercoat does not contain vulcanization accelerator.

DETAILED DESCRIPTION OF THE INVENTION

According to the invention a continuous water and weather resistant covering of several foil layers of synthetic rubber, which can be bonded together thermally or by solvent-bonding, is employed as an undercoating, instead of the customary undercoatings of bitumen or another conventional priming compound. Thus, the undercoating comprises a multilayer elastomer material, the runs of which are tightly bonded together at their overlapping edges, and, as a rule, a post-vulcanizing process also takes place after the installation due to ordinary weather influences.

Without using conventional adhesives, a rubber outermost surface covering is applied to the continuous undercoating. The surface covering may be adhered to the undercoat by the use of a conventional solvent bonding process.

The surface covering consists of synthetic rubber and contains a vulcanization accelerator which is preferably located, however, at the uppermost or top layer of the surface covering. The surface of the outermost covering which contacts the multilayer undercoating is preferably free of vulcanization accelerator. Like the undercoating, the outermost covering post-vulcanizes after the installation, so that a particularly strong and resistant bond is obtained. Advantageously, all of the layers, i.e., the undercoating as well as the outermost surface covering are bonded together and solidified by vulcanization.

The synthetic rubber sheets or runs employed as the outermost surface covering are produced by vulcanization in a vulcanizing machine or in a press by conventional methods.

The vulcanized skin of the outermost rubber covering also represents a wear-resistant layer which is suitable to be walked upon. It has already been mentioned that conventionally such rubber coverings are applied by adhesives to spackled floor surfaces. Thus, in accordance with conventional methods, the sub-flooring must be very even, and great problems arise with respect to the adhesives. With the floor covering according to this invention, on the other hand, it is possible to install the rubber sheets without adhesive directly on the multilayer undercoating of the present invention. As a result, a tight and resistant insulation is always obtained, independent of temperature effects. Depending on the requirements, a rubber covering, fit for the intended use, can be chosen which is joined firmly to the undercoating matched thereto by a conventional solvent-bonding procedure.

The multilayer foil employed as the undercoating is laid over the entire surface area of the sub-floor. It can be brought to the construction site, for instance, in the form of rolls and cemented directly to the spackled floor finish. Subsequently, the rubber outermost surface covering is applied to the undercoating by solvent bonding.

The floor covering according to the invention is absolutely water resistant. The use of adhesives as a discrete layer is eliminated. Therefore, the danger of hydrolysis due to the action of water, which is always present in conventional coverings, is also eliminated. The overall height of the flooring is very small, and is determined only by the thickness of undercoating and the outer covering. Further, a firm bond exists between the outermost surface layer and the undercoating, and this bond is watertight. It is produced by surface particles of the undercoating, and the surface covering flowing into each other. The covering consists entirely of synthetic rubber, and, therefore, has sufficient elasticity with which to adjust to irregularities in the sub-flooring.

The multilayer elastomer materials employed as the undercoating for the outermost surface covering are constructed employing one or several intermediate foil layers containing vulcanization accelerator, with the intermediate foil layer being between an upper and a lower elastomeric foil layer. The upper and lower foil layers are themselves free of vulcanization accelerator, but are comprised of a vulcanizable elastomer.

The layers comprising the undercoating are firmly bonded together, for instance, in a press or a vulcanizing machine. The process is carried out so that the outer layers which do not include vulcanization accelerators are contacted at the same time by the accelerator content of the intermediate layer and are, therefore, chemically bonded to the inner layer.

According to one embodiment of the invention, the undercoating consists of several layers of EPDM (ethylene propylene diene terpolymer) material bonded to each other, where the inner layer or layers may consist of EPDM material and the outer layers of a vulcanizable blending of EPM (ethylene propylene copolymer) and EPDM material.

The multilayer structure built up in this manner is stable also at high temperatures, for instance, at 80° to 100° C. Therefore, there is no danger that the layers might separate under extreme stress. Due to the composition of the intermediate layer of the undercoat which contains vulcanization accelerator, the multilayer undercoat is capable of post-vulcanizing during use, for instance, after installation on an outdoor surface, due to the effects of weather. The properties are substantially determined by the elastic, vulcanizable inner layer which contains the vulcanization accelerator.

As a result, the multilayer structure is likewise elastic and exhibits no cold flow. Thereby, the use properties especially in the case of "working" buildings, and on even surfaces are considerably improved. The post-vulcanization has a particularly advantageous effect on the sensitive seams. Absolute tightness is obtained even under the worst conditions.

Onto the multilayer undercoating constructed in the manner described above, the wear-resistant outermost surface covering of synthetic rubber is applied without adhesive. Among the synthetic rubbers, particularly well suited for this purpose are: SBR (styrene butadiene rubber) as well as other wear-resistant rubber types, for instance, NBR (nitrile butadiene rubber), CR (chlorine rubber), EPDM (ethylene propylene diene terpolymer) or the like.

The outermost surface covering which is bonded to the undercoating consists of multilayer sheets or runs of this material. The layer of the surface covering which directly contacts the undercoating is free of vulcanization accelerator, while the top surface of layers of the outermost surface covering does contain vulcanization accelerator. Thus, the surface covering may include an upper layer of SBR and a lower layer of EPDM rubber. Surprisingly, it has been found that the vulcanizable SBR and the non-vulcanizable EPDM layer enter into a homogeneous bond with each other, and in spite of migration of accelerators from the SBR layer into the EPDM layer, the latter is still solvent-bondable.

The sealing web of which the undercoating is comprised is bonded from run to run to provide the sealing layer, as will be described in greater detail below. Advantageously, a layer of a textile or glass fiber material may be laminated to the bottom surface of the undercoat, which is used to aid in securely bonding the undercoat to the sub-flooring.

The undercoating may be stored, like the rubber sheets of the outermost surface coating, at normal temperatures, for instance, up to 25° C. without limit. The material is also resistant for short periods of time against higher temperatures such as may occur, for instance, during shipment. Also, here, the properties are not changed, i.e., the covering remains bondable.

For installing the floor covering, i.e., of the undercoating with the sheets or runs of the outermost surface covering attached by solution bonding, the runs or sheets of the undercoat may be arranged side by side with the edges of the sheets overlapping. The overlapping areas are then treated with the solvent, such as perchloroethylene, or a a mixture of solvents. Optionally, the solvent may contain a vulcanization accelerator.

The runs of the undercoat are bonded together after the solvent evaporates, to provide a tight, mechanically and thermally resistant skin. Subsequently, the outermost surface covering is likewise adhered by solution bonding. Since the entire covering is sealed thermally or by solution bonding, all seams are securely closed. The effort on the part of the installer is, therefore, minimized.

The following example shows a bondable floor covering constructed in accordance with the invention. This example is illustrative of the invention but is not intended as a limitation thereon.

EXAMPLE

First, a blank with a thickness of 0.3 to 1.5 mm, and preferably 0.6 to 0.7 mm, is drawn which has the composition designated A in the table set forth below, and two blanks with the composition B and a tickness of about 0.5 mm are also drawn. All three layers are vulcanized together in an automatic vulcanizing machine, and thereby combined to form a three-layer structure. Of course, more than three layers can be vulcanized or, if special stiffness is required, a planar structure of textile material can further be inserted between the layers A and B. This merely reduces the elongation and elasticity of the resultant cover web somewhat, while the mechanical properties are improved.

| | A (parts by weight) | B (parts by weight) |
|---|---|---|
| EPDM (ethylene propylene diene terpolymer) | 100.00 | 100.00 |
| Carbon black | 120.00 | 120.00 |
| Naphthenic oil | 60.00 | 60.00 |
| ZnO | 5.00 | 5.00 |
| Stearic acid | 1.00 | 1.00 |
| Aging protection agent | 2.50 | 2.50 |
| Tetramethylthiuramidisulfide | 1.00 | — |
| 2-mercapto benzothiazol | 1.00 | — |
| Zinc diethyldithiocarbamate | 2.00 | — |
| Sulfur | 1.50 | — |

On the suitably prepared spackled floor finish, runs or sheets of the above-described composition are installed side by side with the edges of the individual sheets overlapping. Between the sub-flooring and the undercoating, a layer of nonwoven fabric can be applied which is joined to the undercoating by laminating. The covering is joined to the sub-flooring by hot bitumen, cold bitumen adhesive or another conventional water-resistant adhesive. The overlapping edges of the undercoat runs are solvent-bonded by solvents with a perchloroethylene base in a conventional manner.

Subsequently, an outermost surface covering in sheet or web form is bonded onto the undercoat by the same solvents as the wear-resistant undercoat. To increase the anti-skid properties, the covering or sheets may be provided with bumps or other elevations.

The outermost surface covering consists of synthetic rubber and is manufactured as follows:

An unvulcanized blank of SBR, NBR, CB, EPDM or the like is pressed together with a blank with the following mixture:

| | |
|---|---|
| EPDM (Ethylene propylene diene terpolymer) | 100 parts by wt. |
| Carbon black | 120 parts by wt. |
| Naphthenic oil | 60 parts by wt. |
| ZnO | 5 parts by wt. |
| Stearic acid | 1 parts by wt. |
| Aging protection agent | 2.5 parts by wt. |

The layer built up on the basis of SBR or NBR, CR, EPDM or the like is drawn to a thickness of 2 to 5 mm by means of a calender. The second layer of the composition above, with a basis of SBR, is likewise drawn in a calender to a thickness of 1 to 3 mm. Both layers are placed on top of each other so that the EPDM layer is at the bottom. In a multilayer press, both layers are pressed together at 170° C. for 8 to 9 minutes. The pressure employed is 140 to 200 bar. The multilayer structure is then removed from the press hot.

The vulcanizable SRB layer and the non-vulcanizable EPDM layer are joined together homogeneously. In spite of the migration of accelerators from the SBR layer into the EPDM layer, the latter is still solvent bondable.

The outermost surface covering is solvent-bonded in a conventional manner to the sealing undercoat employing a perchloroethylene based solvent. This bonding step may be performed at the construction site. A floor covering which is wear resistant, extremely tough and tight is obtained, which can also meet heavy stresses in an outdoor environment.

While specific embodiments of the invention have been described with particularity herein, it should be understood that this invention is intended to cover all changes and modifications of the embodiments of the invention chosen herein for purposes of illustration which do not constitute departures from the spirit and scope of the invention.

What is claimed is:

1. A sealing floor covering suitable for use in moist rooms and outdoor areas, comprising an undercoat and an outermost surface covering bonded to the undercoat, wherein the undercoat comprises at least three bonded-together layers of a vulcanizable elastomeric material, wherein at least one intermediate layer of said undercoat contains vulcanization accelerator; and wherein the outermost surface covering is comprised of at least two bonded-together layers of a synthetic rubber in web or sheet form, wherein at least one layer of the surface covering includes vulcanization accelerator, but the layer of the surface covering which contacts the undercoat does not contain vulcanization accelerator.

2. A sealing floor covering suitable for use in moist areas comprising an undercoat and an outer surface covering, wherein the undercoat comprises a plurality of sheets with each sheet being comprised of at least three bonded-together layers of a vulcanizable elastomeric material, wherein at least one intermediate layer of said sheet includes a vulcanization accelerator, said sheets being positioned in a side-by-side manner with the edges of said sheets overlapping and being thermally or solvent-bonded together at said overlapping area; and adhered to said undercoat an outer surface covering in sheet or web form comprised of at least two layers of a synthetic rubber wherein at least one layer includes a vulcanization accelerator, but the layer of said outer surface covering which contacts the undercoat does not contain vulcanization accelerator.

3. The floor covering according to claim 2 wherein the layers comprising said undercoat are bonded to each other by vulcanization, and the undercoat is bonded to the outer surface covering by vulcanization.

4. The floor covering according to claim 2 wherein the outermost layers which comprise the undercoat, do not include vulcanization accelerator.

5. The floor covering according to claim 4 wherein all layers of which the undercoat is comprised, and the outer surface covering, are comprised of an ethylene propylene diene terpolymer based vulcanizable material.

6. The floor covering according to claim 4 wherein the inner layers of elastomeric material of said undercoat are comprised of ethylene propylene diene terpolymer, and the outermost layers of said undercoat are comprised of a vulcanizable blend of ethylene propylene copolymers and ethylene propylene diene terpolymers.

7. The floor covering according to claim 4 wherein the undercoat is intermediate said outer surface covering and a layer of a textile or glass fiber material which is laminated to the undercoat.

8. The floor covering according to claim 4 wherein the outer surface covering is comprised of an uppermost layer of styrene butadiene rubber and a lowermost layer of ethylene propylene diene terpolymer, wherein the lowermost layer does not include vulcanization accelerator, and the lowermost layer contacts the uppermost layer of the undercoat.

9. A method for installing a floor covering comprising:

(a) arranging a plurality of individual undercoat sheets in a side-by-side fashion, with the edges of said sheets overlapping to completely cover the sub-flooring, wherein the undercoat sheets are comprised of at least three bonded-together layers of a vulcanizable elastomeric material, wherein at least one intermediate layer of said undercoat sheet includes a vulcanization accelerator, and (b) bonding said undercoat sheets together in the area of overlap, and (c) solvent or thermally bonding an outer surface covering comprised of at least two layers of a synthetic rubber to the undercoat, wherein at least one layer of the surface covering contains a vulcanization accelerator, but the layer of the surface covering contacting the undercoat does not contain a vulcanization accelerator.

* * * * *